US005452893A

United States Patent [19]

Faulk et al.

[11] Patent Number: 5,452,893

[45] Date of Patent: Sep. 26, 1995

[54] COMPETITIVE, MULTI-LANE VEHICLE RACETRACK

[76] Inventors: John S. Faulk, 506 Rhiems Way; James A. Pendergrass, 6515 Pacific Rd., both of Wilmington, N.C. 28403

[21] Appl. No.: 188,897

[22] Filed: Jan. 31, 1994

[51] Int. Cl.[6] ..... A63F 9/14; A63H 18/00

[52] U.S. Cl. ..... 273/86 C; 446/444; 446/465; 238/10 E; 238/10 F

[58] Field of Search ..... 273/86 R, 86 C, 273/86 B; 446/444, 445, 446, 447, 465, 431, 228, 236, 237, 452; 238/10 E, 10 F

[56] References Cited

U.S. PATENT DOCUMENTS

| | | |
|---|---|---|
| Re. 17,312 | 6/1929 | Beck . |
| 1,551,002 | 8/1925 | Beck . |
| 1,715,891 | 6/1929 | Beck . |
| 3,514,108 | 5/1970 | Tepper . |
| 3,531,119 | 9/1970 | Bonanno . |
| 3,541,724 | 11/1970 | Einfalt . |
| 3,559,334 | 2/1971 | Beny . |
| 3,658,333 | 4/1972 | Carcel . |
| 3,707,804 | 1/1973 | Cook . |
| 3,970,309 | 7/1976 | Sato . |
| 4,156,987 | 6/1979 | Lahr . |
| 4,231,294 | 11/1980 | Arzoumanian . |
| 4,249,733 | 2/1981 | Eddins . |
| 4,357,778 | 11/1982 | Matsumoto . |
| 4,383,688 | 5/1983 | Prehodka . |
| 5,080,628 | 1/1992 | Tate . |
| 5,118,320 | 6/1992 | Miller . |

*Primary Examiner*—Sebastiano Passaniti
*Attorney, Agent, or Firm*—John G. Mills & Associates

[57] ABSTRACT

This invention is a model racetrack that simulates in an authentic manner motor vehicle races including causing the models to crisscross on the straightaway to simulate realistic race conditions. The third and fourth turns have a plurality of lanes which causes some cars to accelerate more than other so that the inside lane tends to go to the outside on the straightaway and the outside lane tends to go to the inside of the straightaway. Also speed controls are provided on a lift conveyor so that the race can be slowed down during "caution flags" and sped back up to race conditions during "green flag" conditions. The models used are authentic reproductions of racing motor vehicles. Different portions of the present invention have different declines for better race simulation of the free wheeling models.

10 Claims, 3 Drawing Sheets

COMPETITIVE, MULTI-LANE VEHICLE RACETRACK

FIELD OF INVENTION

This invention relates to racing games and more particularly to miniature vehicle racetracks.

BACKGROUND OF INVENTION

Since miniature or toy cars have been developed they have been placed on inclines so that they could race down the same. Over an extended period of time, more sophisticated racetracks have been developed including oval racetracks and pair of lanes with various types of speed controls including self-powered vehicles as well as gravity driven vehicles with various types of lifts.

With the upswing in popularity of vehicle racing, particularly stock car racing, the need has developed to provide more realistic miniature racetracks. Although attempts have been made to do this, the development of a continuous running, competitive miniature racetrack has not been provided.

The following references represent the closest prior art of which the inventors are aware:

Concise Explanation of References

U.S. Pat. No. 3,707,804 to Cook discloses a track for self powered or coasting-type vehicles which allows passing of slower vehicles by faster ones and encourages lane changing when vehicles bump one another prior to passing while thereafter reducing the tendency of the vehicles to wander from one side of the track to the other.

U.S. Pat. Nos. 3,970,309 to Sato, 4,156,987 to Lahr, and 3,531,119 to Bonanno all show oval shaped racetracks for miniature vehicles with electrical speed controls for each vehicle either all the way around the track or while going up an incline.

U.S. Pat. No. 3,514,108 to Tepper et al is considered of interest in that it discloses a racing toy having manually manipulated vehicle propelling means in the form of manually activated lifts.

U.S. Pat. No. 3,559,334 to Beny et al discloses a toy vehicle and apparatus for moving the vehicle up an incline including a plurality of finger-like projections on an elongated member that is rapidly oscillated by a motor.

U.S. Pat. Nos. 4,249,733 to Eddins et al, Re. 17,312 to Beck, 1,551,002 to Beck and 1,715,891 to Beck are all considered of general interest in that they disclose scoop-like elevating ramps used in conjunction with one or two lane oval-shaped toy raceways.

U.S. Pat. No. 5,080,628 to Tate discloses single track toy roller coaster apparatus with a fingered lift mechanism while U.S. Pat. No. 3,541,724 to Einfalt discloses a toy roadway layout of multiple layers with a fingered lift mechanism.

Finally, U.S. Pat. Nos. 4,357,778 to Matsumoto et al and 5,118,320 to Miller are considered of general interest in that they disclose multi-level toy vehicle trackways and roller coaster toys.

BRIEF DESCRIPTION OF INVENTION

After much research and study into the above mentioned problems, the present invention has been developed to provide a competitive, multi-lane, miniature racetrack that allows continuous racing of multiple vehicles. These vehicles are gravity powered on an inclined oval raceway. A means for controlling a rear engaging conveyor is also provided for normal green flag racing as well as slow downs during caution flags.

The present invention, in its preferred embodiment, uses 1/64th scale size toy stock cars widely sold under the brand name Matchbox Toys. These miniature racecars have authentic shapes, numbers and decals of the cars driven by NASCAR drivers.

The present invention is a continuous lap track with speeds of all the cars being controlled by the Track Officials, the present invention is very much a spectator sport in the same manner as actual stock car races.

In view of the above it is an object of the present invention to a provide competitive, multi-lane miniature vehicle racetrack with continuous racing to simulate actual vehicle races.

Another object of the present invention is to provide a continuous lap, miniature vehicle racetrack that is controlled by a racetrack Official who controls the racetrack speed similar to speed control flags on actual racetracks.

Another object of the present invention is to provide, on a gravity driven miniature racetrack, a conveyor for lifting vehicles on a first come, first serve basis with means for controlling the overall speed of the racetrack by controlling the speed of the lift.

Another object of the present invention is to provide a toy racetrack that simulates the spectator sport of vehicle lap racing.

Other objects and advantages of the present invention will become apparent an obvious from a study of the following description and any accompanying drawings which are merely illustrative of such invention.

DETAILED DESCRIPTION OF INVENTION

Figure 1:
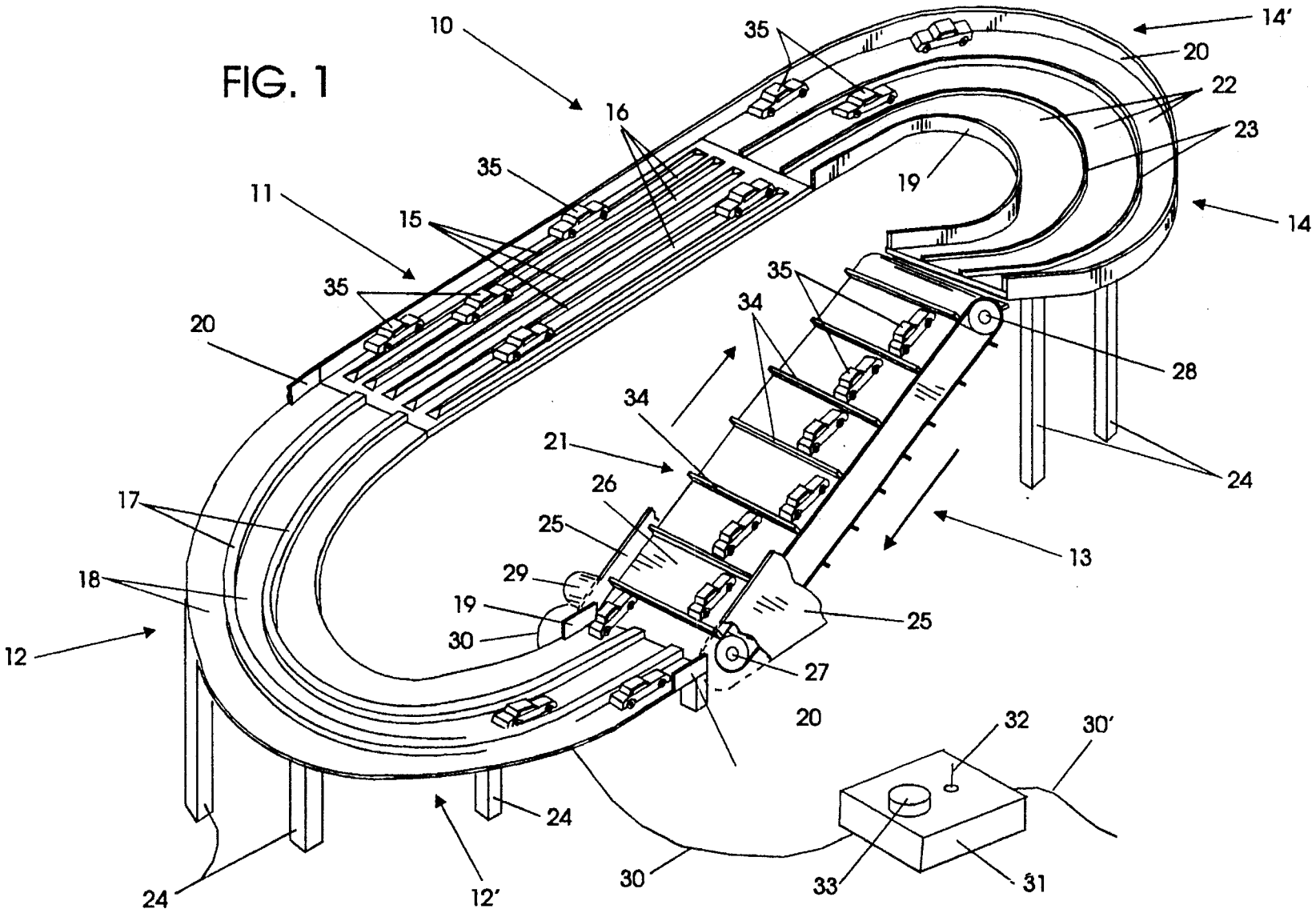
FIG. 1 is a perspective view of the competitive, multi-lane miniature vehicle racetrack of the present invention.
Figure 2:
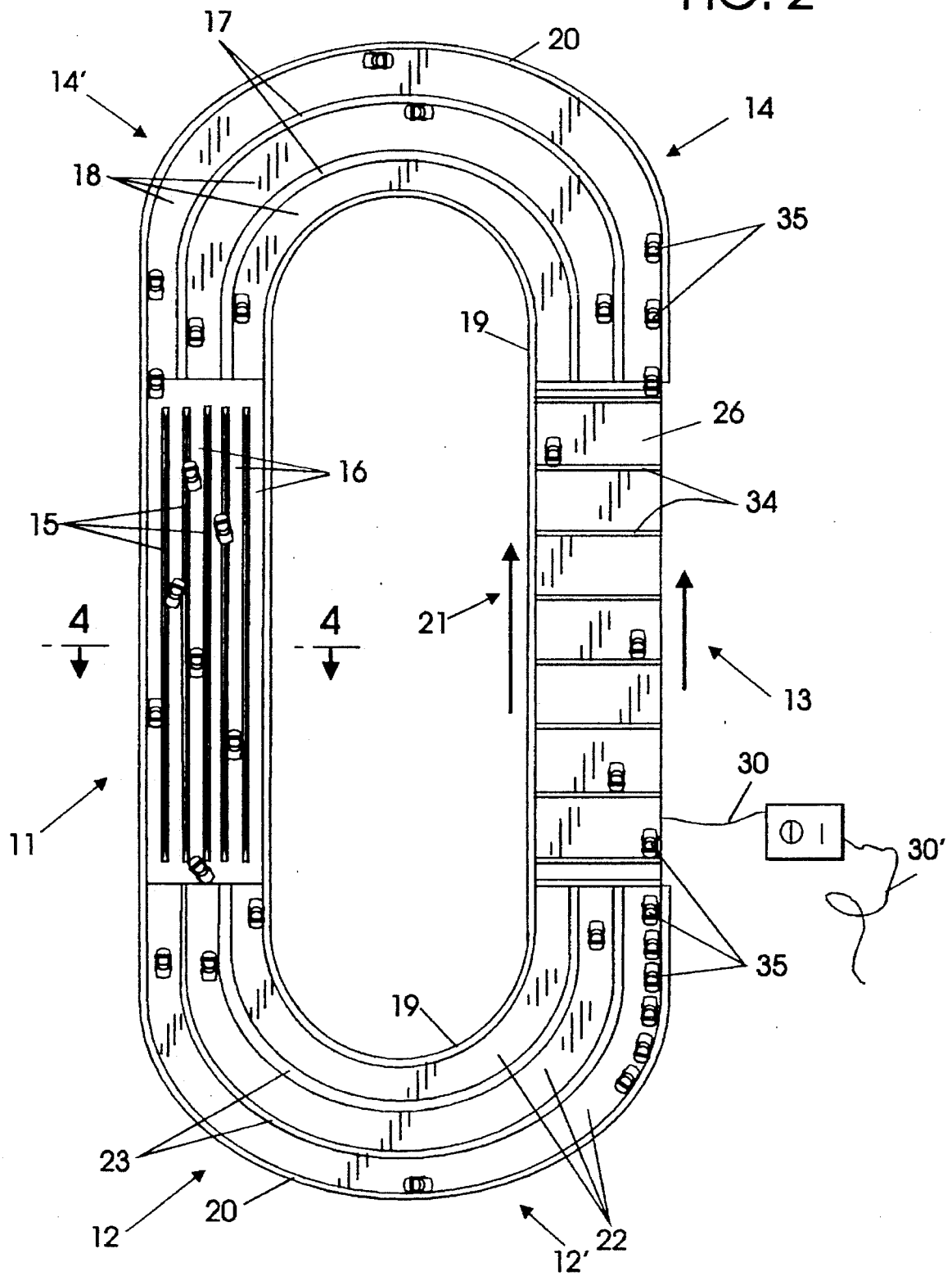
FIG. 2 is a top plan view thereof.
Figure 3:
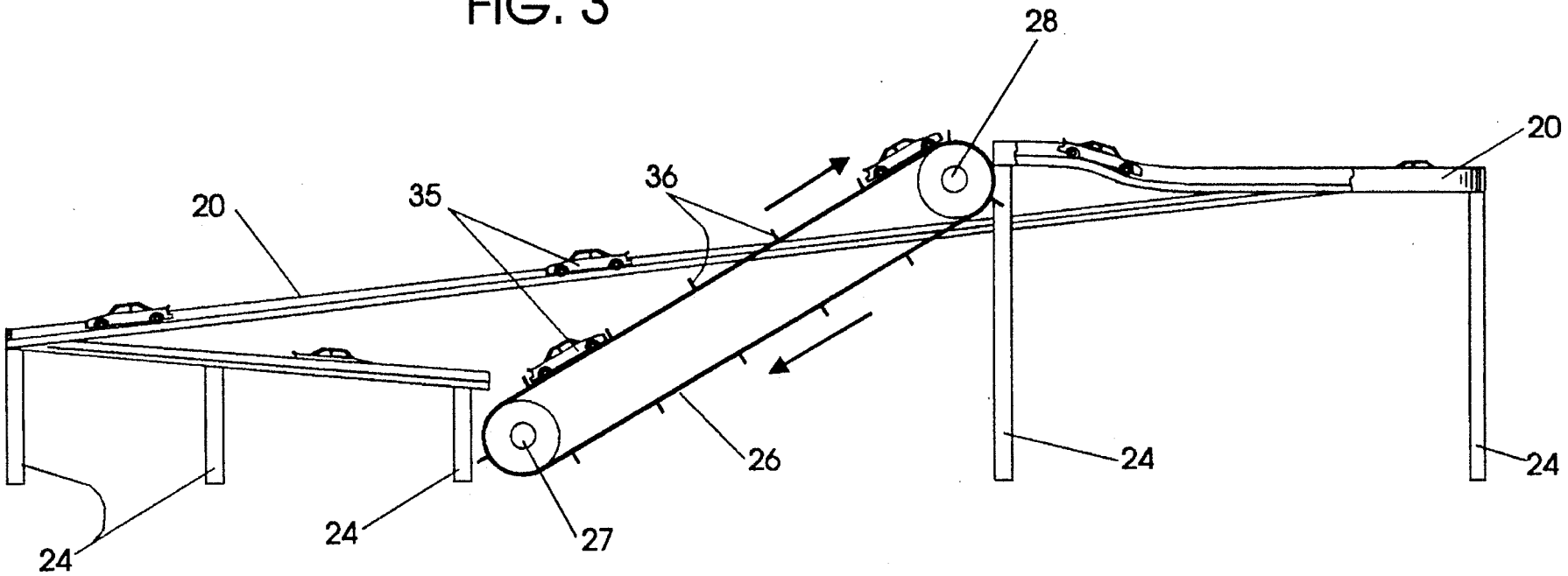
FIG. 3 is a side elevational view of the continuous racing lift means of the present invention.
Figure 4:
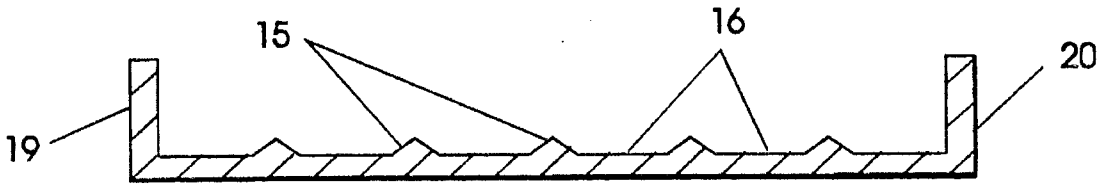
FIG. 4 is a sectional view taken through lines 4—4 of FIG. 2.

With further reference to the drawings, the competitive, multi-lane toy vehicle racetrack of the present invention, indicated generally at 10, includes a front stretch indicated generally at 11, first and second turns, indicated generally at 12 and 12', a back stretch indicated generally at 13 and third and fourth turns indicated generally at 14 and 14'.

The dimensions given in the following description are for toy stock cars that are 1/64th scale with car lengths of approximately three inches, a width of one and one eighth inch and tire heights of approximately one-half inch. These model cars are sold under the brand name "Matchbox" by Matchbox Toys (USA) Ltd., subsidiary of Tyco Toys: Inc., Mount Laurel, N.J. 08054 and are readily available at all toy stores and other locations where toys of this type are sold.

The front stretch 11 is preferably six, one car wide lanes with each lane being separated from the adjacent lanes by a low guide 15 preferably 1/32 of an inch high.

The front stretch straightaway is approximately 52 inches long and has an incline drop of preferably five inches which is at a slope ratio of 10.4 to 1.

The first and second turns 12 and 12' extending from the front stretch 11 to the back stretch 13 are approximately 60 inches on the outside lane with a three-inch drop or an incline ratio of 20 to 1 which means that the race cars are slowing down at that point.

In the first and second turns 12 and 12' there are only three lanes 18 that are separated by curbs 17 that are approximately ⅛th inch high. Each of these lanes are, however, two cars wide. There are, of course, inside and outside guardrails 19 and 20 that extend from the beginning of the third turn 14 past the front stretch 11 and to the end of the second turn 12' as can clearly be seen in FIG. 1.

The back stretch 13, when viewed in the top plan, is basically the same length as the front stretch 11 with 52 inches from the end of the second turn 12' to the beginning of the third turn 14. This back stretch 13 is a conveyor, indicated generally at 21, which moves the cars up 14 inches which is a relatively steep incline ratio of 3.7 to 1.

The conveyor 21 does not have lanes but at its upper end the cars are pushed into the third turn 14 which is ten inches wide with three lanes 22 two cars wide separated by ⅛th inch high curbs 23. This arrangement continues through the fourth turn 14' with a decline from entering the third turn to exiting the fourth turn being a drop of six inches. The outside lane is approximately 60 inches for a slope of 10 to 1.

In summary, the model stock car racetrack of the present invention 10 is preferably ten inches wide all the way around with an infield 18 inches wide and 70 inches long. The overall length of the racetrack is 7½ or 90 inches long by 38 inches wide. Being an oval track, the exterior distance of the outer track is approximately 60 inches in the first and second turns 12 and 12' and another 60 inches in the third and fourth turns 14 and 14'. The front stretch straightaway 11 is 52 inches as is the back stretch 13.

A plurality of racetrack supports 24 are provided in varying lengths, the lowest point at the end of the second turn 12' where the cars enter the back stretch/conveyor 13 is seven inches with the beginning of the third turn 14 at the top of the conveyor being 21 inches. The point at which the cars exit the fourth turn 14' and enter the front stretch straightaway 11 is 15 inches high. Where the straightaway enters the first turn 12, the height is ten inches at the outside guardrail and at the end of the second turn 12' entering the back stretch/conveyor 13 again is seven inches at the guardrail.

Conveyor guardrails 25 are provided on opposite sides of the conveyor belt 26. This conveyor belt is mounted on a lower, drive roller 27 and an upper idler roller 28.

A variable speed motor 29 that can operate from zero r.p.m. up and is operatively connected to lower drive roller 27. A power cord 30 connects motor 29 with control box 31. This control box includes an Off/On switch 32 and a rheostat control 33 for controlling the speed of variable speed motor 29. A power cord 30' is also connected to control box 31 at one end and is adapted to plug into any convenient electrical outlet (not shown). Since the operation of variable speed motors, rheostat speed controllers and Off/On switches are well known to those skilled in the art, further detailed descriptions of the same is not deemed necessary.

A plurality of pusher bars are mounted on the exterior of conveyor belt 26 and are spaced slightly further apart than the longest model stock car 35 being used. This spacing would usually be approximately 3¼ inches for three-inch cars. Each of the pusher bars are 3/16 to ¼th inch high to engage the rear bumpers of the cars as they come out of the second turn 12'.

When the conveyor 21 is operating as indicated by the arrows in FIG. 1, the cars 35 will move up the back stretch incline. As they approach the upper roller 28 and the pusher bars begin to rotate thereabout, the cars will get an extra push for more power when entering the third turn 14.

As cars come off the conveyor 21, they enter one of the three lanes 22 around the third and fourth turns 14 and 14' before moving into the straightaway front stretch 11. At this point the curbs 23 separating the three lanes in the turns changes to six lanes separated by lower guides 15.

Free wheeling model stock cars 35 have a tendency to steer either left, right or straight. This causes the cars to change lanes on their own when they enter the front stretch straightaway 11. This straightaway has a slight bank to it that causes most cars to tend to go to the inside lane from the high lane. The force from coming out of the low lane, because it is a shorter distance that translates into a higher speed, these cars tend to go high. The result of the above is that the cars crisscross the track on the front stretch 11.

The cars next enter the first turn 12 which has three lanes 16 two cars wide separated by the higher curbs 17. The downward slope of the first and second turns 12 and 12' is only a third as much as the straightaway the cars are leaving and, therefore, they begin to slow down prior to coming into engagement with the pusher bars 34 of conveyor belt 26 to be again lifted to the beginning of the third turn 14.

To simulate an actual model stock car race in as authentic manner as possible, the cars are lined up on the front stretch straightaway in two columns in the same manner as actual stock car races. A small chock is placed be used in front of the two lead cars to hold them in place.

When the signal is given to start the race, the chocks are simultaneously removed and the cars move by gravity down the straightaway toward the first turn 12. They will then enter one of the three lanes 18 and curve around to the conveyor 21. There they will be picked up by the conveyor belt 26 with the pusher bars 34 engaging the rear of the various cars. The speed control 33 is set on normal race speed and the cars move at that predetermined speed up the conveyor and are pushed off onto the beginning of the third turn 14. The cars then move rapidly around the third and fourth turns 14 and 14' and enter, at high speed, the front stretch straightaway 11. As indicated above, the cars at this point will go in different directions crisscrossing the low guides 15 on said straightaway before they reenter the third turn lanes 22.

Should one or more cars either wreck or spin out in the straightaway 11 or as they enter the third turn lanes 22, the Track Official will, by turning the rheostat, slow the speed of the conveyor 21 to simulate a Caution Flag. Once the wrecked cars have been removed from the track and the cars that have spun out are straighted out to reenter the race, a Green Flag can be used to signal return to full racing and through the control box rheostat, the conveyor 21 returns to race speed.

If, of course, there is an extremely bad wreck, then the race can be stopped by the Track Officials by either turning the speed control to zero r.p.m. or turning the Off/On switch Off.

From the above it can be seen that the present invention simulates very realistically stock car racing with all the relevant rules and regulations being followed. This also includes the possibility of exciting spin outs, wrecks and the like which causes the various flag conditions to be ordered by the Track Officials.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A model racetrack for simulating actual motor vehicle races comprising: a generally oval shaped racetrack having a front straightaway leading to first and second turns, a backstretch, and third and fourth turns back to the front straightaway; means for lifting model vehicles exiting the second turn and traveling along the backstretch prior to entering the third turn; at least one inside lane and at least one outside lane separated by a curb means in said third and fourth turns, whereby model vehicles will travel a shorter distance in said inside lane of said third and fourth turns than vehicles traveling in the outside lane; and multiple lanes in said front straightaway separated by relatively low guides, whereby vehicles entering the straightaway from the inside lane will tend to go to the outside of the straightaway across the guides while vehicles entering the straightaway from the outside lane will tend to go to the inside of the straightaway across said guide to simulate actual motor vehicle races including the possibility of wrecks and spin outs.

2. The model racetrack of claim 1 wherein the front straightaway is slightly banked.

3. The model racetrack of claim 1 wherein at least three lanes are provided on said third and fourth turns.

4. The model racetrack of claim 3 wherein each of said lanes of said third and fourth turns are two vehicle wide lanes.

5. The model racetrack of claim 4 wherein said straightaway is at least six lanes wide.

6. The model racetrack of claim 1 wherein said first and second curves include at least two lanes.

7. The model racetrack of claim 1 wherein the means for lifting model vehicles as they pass along said backstreach is a conveyor belt with a plurality of transverse bars mounted thereon to engage the rear of the model vehicles during the lifting process.

8. The model racetrack of claim 1 wherein the front straightaway is on a decline of approximately 10 to 1; the first and second turns on a decline of approximately 20 to 1; the backstretch is on an incline of approximately 4 to 1; and the third and fourth turns are on a decline of approximately 10 to 1.

9. The model racetrack of claim 1 wherein the area inside the oval racetrack is designated an an infield area for model cars that are not racing and for model cars that have been involved in wrecks and removed from the track.

10. The model racetrack of claim 1 wherein the speed of operation of the means for lifting the model vehicles on the backstretch can be controlled to simulate "green flag" race speeds and "caution flag" slower speeds, whereby more realistic simulation of authentic vehicle races can be achieved.

* * * * *